US006942572B2

(12) United States Patent
Inoue

(10) Patent No.: US 6,942,572 B2
(45) Date of Patent: Sep. 13, 2005

(54) SYMBOL DISPLAY DEVICE AND GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 0 days.

(21) Appl. No.: 10/209,610

(22) Filed: Aug. 1, 2002

(65) Prior Publication Data

US 2003/0232643 A1 Dec. 18, 2003

(30) Foreign Application Priority Data

Jun. 14, 2002 (JP) ..... 2002-174897

(51) Int. Cl.[7] ..... A63F 9/24
(52) U.S. Cl. ..... 463/20; 463/16
(58) Field of Search ..... 273/143 R, 118 R; 463/1, 12–25, 40–42

(56) References Cited

U.S. PATENT DOCUMENTS 4,695,053 A * 9/1987 Vazquez et al. ..... 463/18
4,718,672 A * 1/1988 Okada ..... 463/20
4,874,173 A * 10/1989 Kishishita ..... 273/143 R
5,411,271 A * 5/1995 Mirando ..... 463/9
5,584,764 A * 12/1996 Inoue ..... 463/20
5,609,524 A * 3/1997 Inoue ..... 463/20
5,695,188 A * 12/1997 Ishibashi ..... 273/143 R
5,697,843 A * 12/1997 Manship et al. ..... 463/20
5,704,835 A * 1/1998 Dietz, II ..... 463/20
5,722,891 A * 3/1998 Inoue ..... 463/20
5,752,881 A * 5/1998 Inoue ..... 463/20
5,766,074 A * 6/1998 Cannon et al. ..... 463/16
5,803,451 A * 9/1998 Kelly et al. ..... 273/118 R
5,807,172 A * 9/1998 Piechowiak ..... 463/20
5,836,819 A * 11/1998 Ugawa ..... 463/30
5,839,955 A * 11/1998 Mangano et al. ..... 463/16
5,890,962 A * 4/1999 Takemoto ..... 463/20
6,027,115 A * 2/2000 Griswold et al. ..... 273/143 R
6,056,642 A * 5/2000 Bennett ..... 463/20
6,106,393 A * 8/2000 Sunaga et al. ..... 463/20
6,126,165 A * 10/2000 Sakamoto ..... 273/143 R
6,206,781 B1 * 3/2001 Sunaga et al. ..... 463/20
6,302,790 B1 * 10/2001 Brossard ..... 463/20
6,319,124 B1 * 11/2001 Baerlocher et al. ..... 463/20
6,471,208 B2 * 10/2002 Yoseloff et al. ..... 273/143 R
6,554,703 B1 * 4/2003 Bussick et al. ..... 463/20
6,558,254 B2 * 5/2003 Baelocher et al. ..... 463/20
6,641,477 B1 * 11/2003 Dietz, II ..... 463/20
6,695,696 B1 * 2/2004 Kaminkow ..... 463/16
2002/0123378 A1 * 9/2002 Bucknall et al. ..... 463/16
2003/0073484 A1 * 4/2003 Jo ..... 463/20
2003/0144050 A1 * 7/2003 Keaton et al. ..... 463/19
2003/0199295 A1 * 10/2003 Vancura ..... 463/16

FOREIGN PATENT DOCUMENTS

JP 2000-061033 2/2000

* cited by examiner

*Primary Examiner*—Michael O'Neill
(74) *Attorney, Agent, or Firm*—Young & Thompson

(57) ABSTRACT

Fifteen reels are arranged in five lines and three columns. Plural kinds of symbols are drawn on each reel at a constant pitch, so that one symbol is observed through a display window. There are three type winnings, such as a line winning, which is completed when predetermined symbols are lined on the winning line, a block winning, which is completed when predetermined symbols are displayed from a group of display windows, and an ANY position winning, which is completed when a fixed number of predetermined symbols are displayed. When one of winnings is completed, the symbols constituting the winning is illuminated by a specific color allocated the winning.

11 Claims, 10 Drawing Sheets

SYMBOL DISPLAY DEVICE AND GAME MACHINE

BACKGROUND OF THE INVENTION

1. Field of the Invention

The present invention relates a symbol display device and a game machine therefor, more particularly to the symbol display device that winning is determined by symbol combination upon a stop of rotating symbols and the game machine having the symbol display device.

2. Explanations of the Prior Arts

Recently, game machines, such as a slot machine, a pachinko machine, and the like into which a symbol display device is incoporated as a winning device are widely used.

U.S. Pat. No. 5,584,764 discloses a slot machine with a symbol display device of a reel-driven type that has nine reels with plural types of symbols. The nine reels are arranged thereon in matrix of three rows and three columns, and each reel is respectively driven by a motor. Also, a symbol display device of a video type which displays a simulated reel rotation of nine reels on an electronic display device, such as a LCD panel or a CRT (cathode-ray tube), is widely used. Such symbol display device of a reel drive type and a video type is incorporated into pachinko machines as well. In either case, whether there is a winning game or lost game is determined in accordance with symbol combination completed on a winning line upon a stop of symbols.

Generally, winning is obtained when the identical symbols are set on a winning line. The winning combination is called "the line winning". JPA 2000-61033 discloses a symbol display device that, when "the line winning" is in reach state (two identical symbols stop on the winning line, waiting for the last identical symbol to be stopped), the winning line is illuminated by a color identical with the symbol of "the line winning", for amusing a player, as well as informing the reach state. In this case, as each symbol is drawn by different colors in accordance with a rank of award, such as how much coins are paid out, the player can see what symbol makes the reach state in advance for instance, which enables the player to grasp the present game situation.

In addition to "the linewinning", however, the symbol display device has other kind of winnings. When "the line winning" and the other winnings are simultaneously in reach state, it is necessary to illuminate the reach state of both the winning combination for completing the line winning and the other winnings (illuminating display windows to be a reach state or illuminating from the inside of the corresponding reels). If color illumination is reciprocally performed, this may confuse the player as lamp performance to suggest a game condition. Therefore it is hard to indicate the reach state to each winning clearly.

It is possible to utilize the above reach state display device in order to display the winning which is completed upon a stop of all reels. Likewise, in case of a display of the winning, it is difficult to display each winning distinguishable when plural winnings are completed.

SUMMARY OF THE INVENTION

A main object of the present invention is to provide a symbol display device that displays winning by color illumination which is different in accordance with each winning, and a game machine having the symbol display device.

Another object of the present invention is to provide a symbol display device that enables a game player to understand what kind of winnings are completed at first sight upon a stop of each reel.

To attain the above object and the other object, a symbol display device of the present invention is to provide an indicative means that indicates each symbol constituting the predetermined winning by use of different colors allocated for each predetermined winning. In the symbol display device of the present invention, plural symbol rows of successively movable are arranged in matrix, and each symbol row has plural kinds of symbols arranged at a predetermined pitch. A display window is formed for each symbol row, for at least one of the symbols can be observed when the symbol row stops. The judging means judges whether the symbol combination stopped in the plural display windows constituting a winning line or a winning area completes one of the predetermined winnings. When the plural winnings are completed simultaneously, the indicative means indicates each symbol constituting each winning with different colors that are distinguished from each of the winning. The color illumination is performed by color light source, such as color LED, that is arranged inside each reel.

According to the symbol display device of the present invention, when one of the plural different winnings is hitted, as the symbol constituting its winning is displayed with the corresponding color, the winning condition can be clearly recognized by the game player at a glance. And in case plural different winnings are completed at the same time, each winning is illuminated with different colors. In case a symbol constitutes plural different winnings, the symbol is illuminated repeatedly by corresponding colors. Consequently, the winning state is obvious to the game player, preventing him from confusion.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
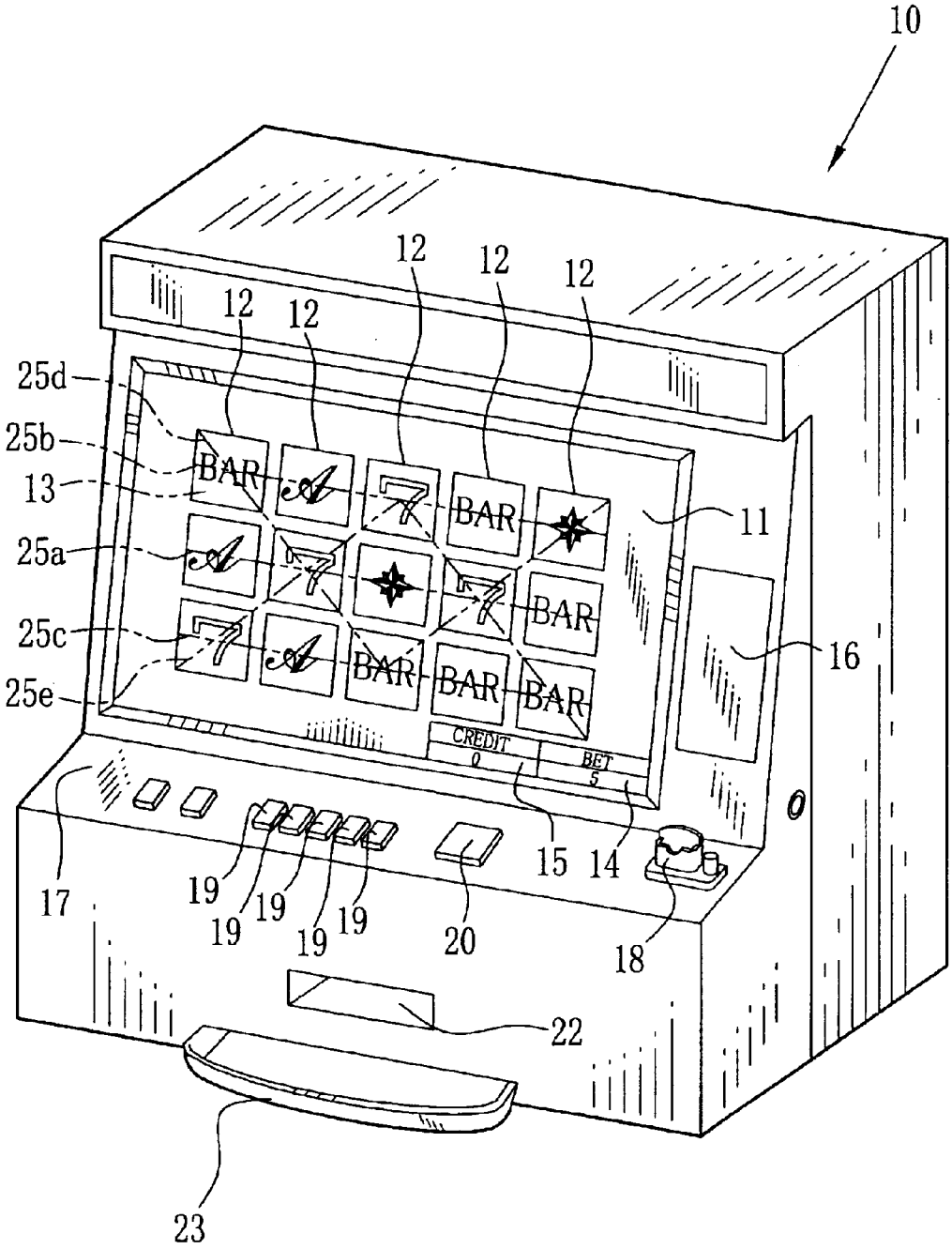
FIG. 1 is a front perspective view illustrating a slot machine in which the present invention is embodied.
Figure 12:
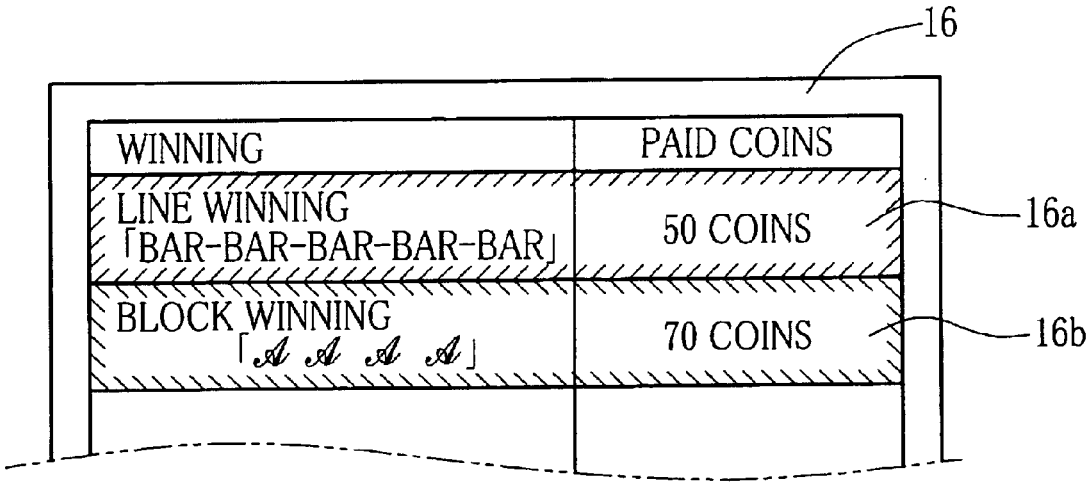
FIG. 12 is an explanatory view illustrating an example of an award table.

As shown in FIG. 1, a slot machine 10 is provided with a symbol display device 45 displaying fifteen symbols. The symbol display device 45 consists of a reel unit on which fifteen reels 13 of three rows and five columns are arranged in matrix and its drive mechanism. A front panel 11 has display windows 12 corresponding to each reel 13. Upon a stop of the reel 13, one symbol is observed through the respective display windows 12. Note that three symbols of the center and its up and down may be observed through the display window 12. In this case, the symbols of the top and the down to be observed may be only a part respectively. Downward the front panel 11 has a bet number display window 14 for displaying a betted total coin or token (it is referred to as coin hereafter), and a credit display window 15 for displaying a coin stocked up in a credit counter. The front panel 11 has an award table 16 which represents a relation between each winning and payout coins. As an example shown in FIG. 12, winnings 16*a* and 16*b* are drawn on the award table 16 by different colors respectively. Each color corresponds to a illuminating color to illuminate the symbol upon winning. For instance, the winnings 16*a* and 16*b* are drawn by yellow and blue respectively.

An operation panel 17 on the lower part of the front panel 11 is provided with a coin slot 18, a bet button 19, and a start button 20. Being inserted into a coin slot 18, a bet is performed by operating a bet button 19 on the operation panel 17. The bet button 19 corresponds to each winning line. When one bet button 19 is depressed for one time, the corresponding winning line is effective, and one coin is betted to this winning combination. When the bet button 19 is depressed for plural times, plural coins are betted in accordance with how many times the bet button 19 is operated. Note that coin insertion includes to bet a coin stored in the credit counter as well as actual coin insertion into the coin slot 18. In this case, the credit counter reduces in correspondence to the betted coins.

The wining line consists of three lateral winning lines (a first to a third winning lines 25*a*–25*c*), a bottom angled winning line (a forth winning line 25*d*), and a top angled winning line (a fifth winning line 25*e*). On depressing the start button 20 after betting a coin, each reel starts rotation, and, after a predetermined period, stops automatically and randomly. It may provide a stop button for each reel to manually stop each reel. Note that a coin outlet 22, and a coin saucer 23 are formed on the downside of the operation panel 17.

Figure 2:
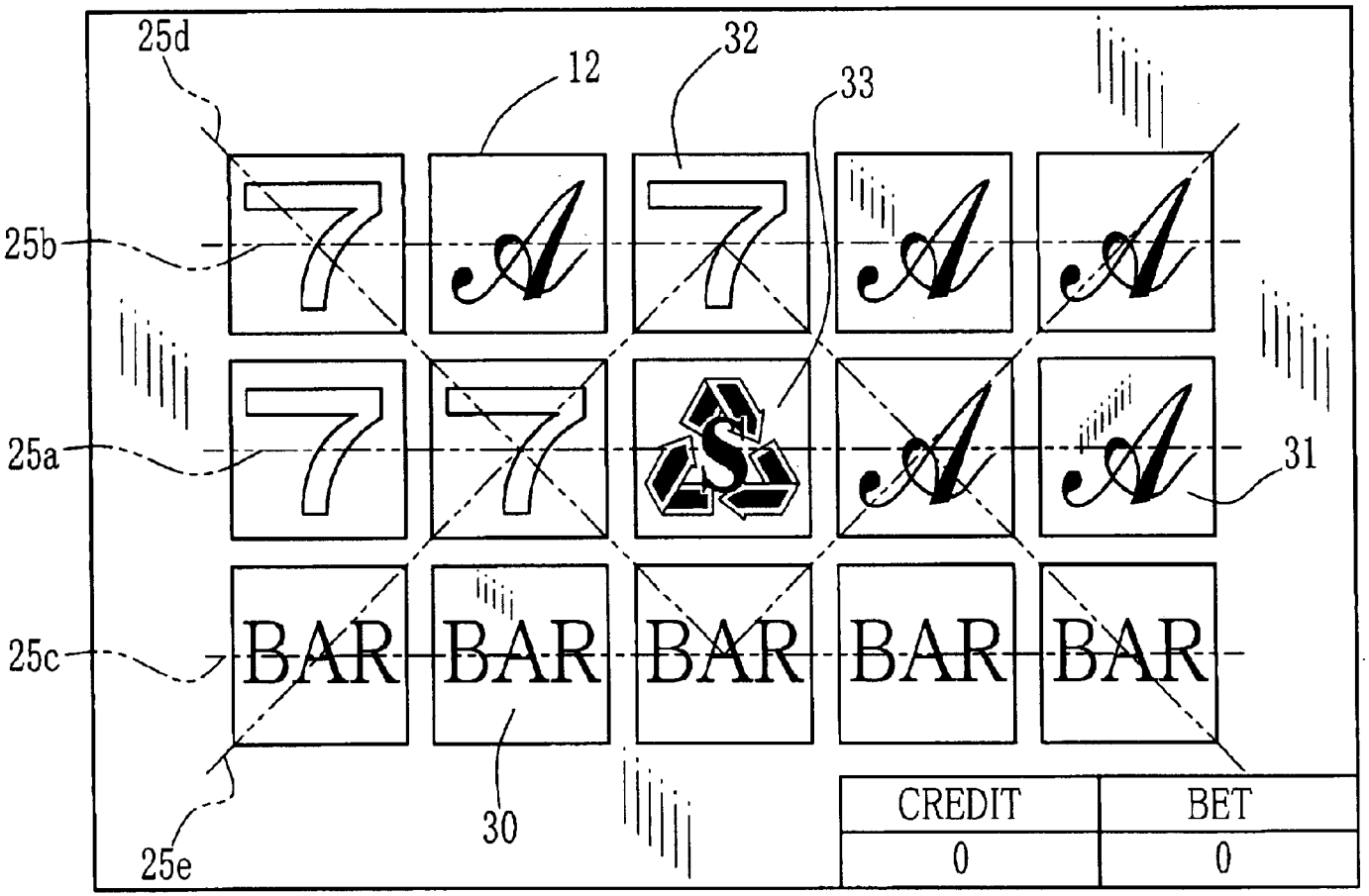
FIG. 2 is a front view illustrating a front panel of the symbol display device.

In addition to the line winning, as shown in FIG. 2, the slot machine 10 has other winnings, such as a block winning, an ANY position winning, and a bonus trigger hit. For instance, the line winning is completed when combination by predetermined symbols, such as "BAR" 30 and the like, is arranged on the effective winning line.

The block winning is completed regardless of the effective winning line when plural predetermined symbols are set at a fixed spot in groups. In the present embodiment, the symbol constituting the block winning consists of a symbol "A" 31, and a symbol "7" 32. The block winning is completed when the symbol "A" 31 or the symbol "7" 32 are displayed through the four display windows 12 constituted of two rows and two columns. Note that FIG. 2 shows the state in which the block winning by the symbol "A" 31 is completed.

The ANY position winning is completed when a predetermined number of specific symbols or more are displayed through the fifteen display windows 12. In the present embodiment, the ANY position winning is completed when at least four pieces of the symbols "A" 31 or the symbols "7" 32 are displayed. It is designed in case of completion of the ANY position winning that the pieces of coins to be paid out is increased in accordance with the number of the symbol "A" 31 or the symbol "7" 32. Note that FIG. 2 shows the state in which two ANY position winning by the symbol "A" 31 and the symbol "7" 32 are completed.

The bonus trigger hit is completed when specific symbols are displayed through the predetermined display windows 12. This bonus trigger hit, unlike other winnings, does not pay out the coin but entitles the player to participate in the bonus game. When shifted to the bonus game, the player is entitled to play the game for a predetermined number of times without inserting coins. In case of winning during this period, coins are paid out in accordance with its winning. In the present embodiment, the symbol for the bonus trigger hit is the symbol "S" 33. The bonus trigger hit is completed when the symbol "S" 33 is displayed in the center of the display window 12.

Note that the kind and the condition for completing the winning is not necessarily limited to the above embodiment, but can be suitably set in consideration of a character of the game. Also, the number of payout coins for each winning can be appropriately set in consideration of the kind of winning, and a rate of the award.

Figure 3:
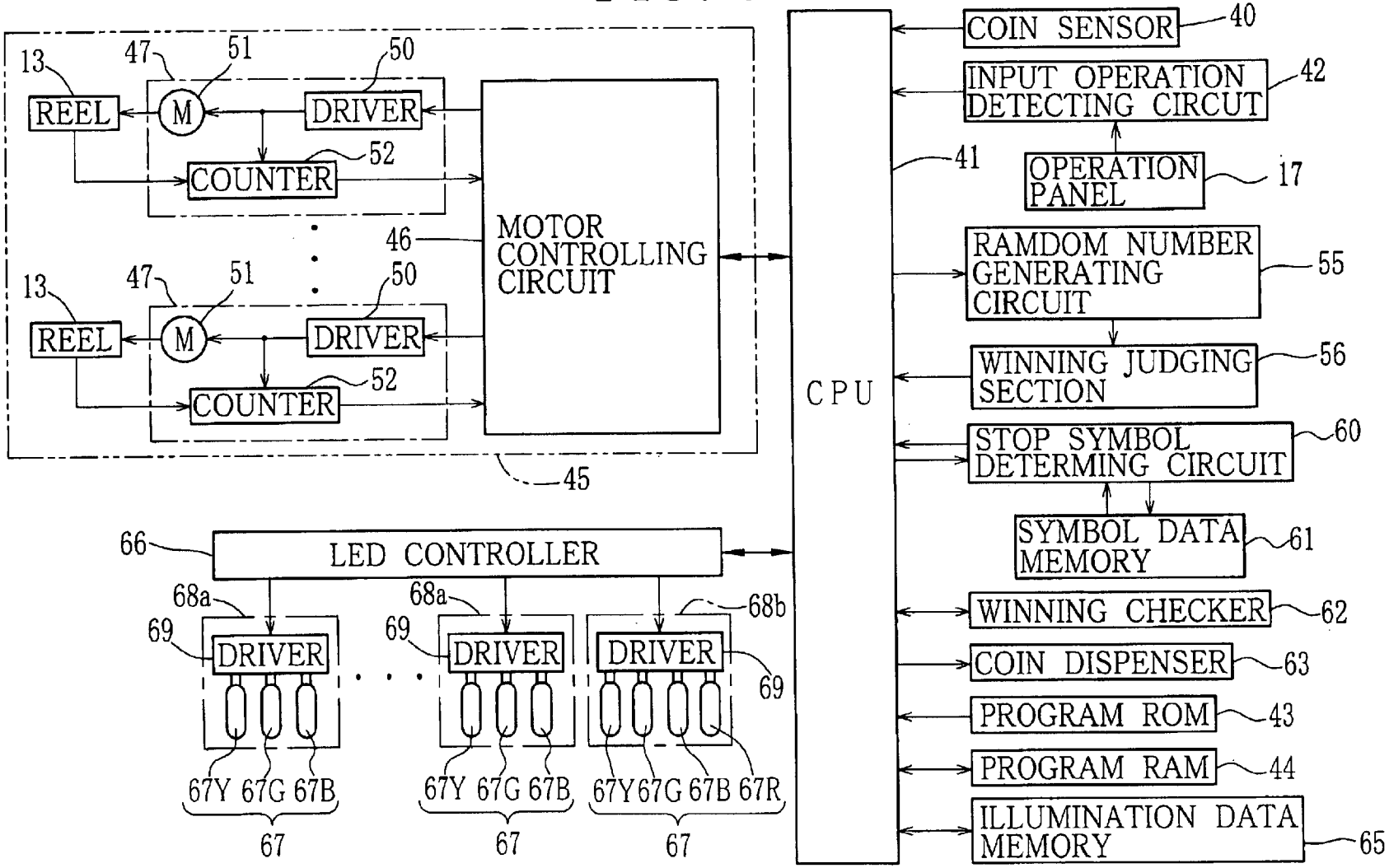
FIG. 3 is a functional block diagram illustrating electrical structure of the slot machine.

As shown in FIG. 3, there provides a coin sensor 40 behind the coin slot 18, for inputting a coin detecting signal to a CPU 41 upon detecting every proper coin insertion. In receipt of a coin detecting signal, the CPU 41 displays how many coins are inserted on the credit display window 15. Upon operating each buttons on the operation panel 17, an input operation detecting circuit 42 inputs an operation signal to the CPU 41. The CPU 41 takes generally control over the slot machine 10 in accordance with game programe stored in a programe ROM 43, so the CPU 41 makes the operation invalid on receiving an operation signal unrelated to the proceeding of the game. When the bet button 19 is pushed, the CPU 41 distinguishes the winning line corresponding to the bet button 19, then effectuates the winning line. The CPU 41 displays the bet number from the bet number display window 14, and stores the bet number in a program RAM 44 temporarily.

When the start button 20 on the operation panel 17 is depressed, a start signal is inputted to the CPU 41, which sends a drive signal to a motor control circuit 46 of the symbol display device 45. The motor control circuit 46 receives the drive signal from the CPU 41, for controlling the reel 13 to rotate and stop through a drive unit 47 provided for each reel. Since each of the drive unit 47 has common structure, the drawing is illustrated in brief. The drive unit 47 consists of a driver 50, a stepping motor 51, and a counter 52.

Receiving a rotation signal from the motor control circuit 45, the driver 50 supplies a drive pulse to the stepping motor 51, which makes rotation for every unit step angle in accordance with the number of drive pulse inputted from the driver 50.

A spindle of the stepping motor 51 is connected with the reel 13, whose rotatary position having one-to-one correspondence with the number of the drive pulse to be supplied to the stepping motor 51. The counter 52 counts the number of drive pulse supplied to the stepping motor 51 in real time. And every time the stepping motor 51 passes the home position by its rotation, the calculated value is reset to "0". Namely, the calculated value of the counter 52 represents the rotatory position of the reel 13. Moreover, since the kind of symbol arranged on the reel 13 against the home position of the stepping motor 51 is known in advance, the kind of the symbol visible from the display window 12 can be distinguished on the basis of the calculated value of the counter 52.

When the start signal is inputted to the CPU 41, a random number generating circuit 55 samples a random number and inputs it to the winning judging section 56, where the outcome of the present game is determined. In case of winning, whether it is a single winning or plural winnings constituted of different combinations is determined, then the winning judgement signal corresponding to the kind of winning is inputted to the CPU 41.

A stop symbol determining circuit 60 determines a symbol to be displayed on each reel on the basis of a winning judgement signal from the winning judging section 56 and a symbol data memory 61. For instance, in case of the line winning, the stop symbol determining circuit 60 determines a symbol for constituting the line winning, and on which lines the symbol is stopped. In case of the ANY position winning, the stop symbol determining circuit 60 determines a symbol therefor determining whether it is the symbol "A" or the symbol "7") and how many and where the decided symbols are displayed. In case of the block winning, it is the same as the ANY position winning. And in case plural different winnings are completed at the same time, the stop symbol determining circuit 60 determines the kind of the symbols and where the decided symbols for winning are displayed.

In the symbol data memory 61, the kind of symbol is matched to the number of drive pulse to stop the symbol in the display window 12. Therefore when the symbol to be displayed on each reel is determined by the stop symbol determining circuit 60 determines, the data on the number of drive pulse for every reel is also chosen. The number data on the drive pulse for every reel is inputted to the CPU 41, which performs stop control of the stepping motor 51 through the motor control circuit 46 when the calculated value of the counter 52 is consistent with the number of drive pulse inputted from the stop symbol determining circuit 60. Due to this, one symbol is displayed in each display window.

Upon a stop of all reels 13, a winning checker 62 checks a calculated value of the counter 52 to confirm whether the winning is displayed or not. The symbol decided by the stop symbol determining circuit 60 is normally in sight through the display window 12. Taking an unexpected happening into consideration, such as the stepping motor 51 runs off, however, the last-displayed symbol is confirmed on the basis of the calculated value of the counter 52. When the winning checking section 36 checks the winning combination to be displayed, a coin dispenser 63 dispenses a predetermined piece of coins in accordance with its winning.

In order to provide color illumination to the winning combination, an illumination data memory 65 stores illumination data for illuminating a LED assembly 67 provided inside each reel. The inside of each reel has a LED unit 68*a*, which is constituted of a LED assembly 67 of a yellow LED 67Y, a blue LED 67B, and a green LED 67G. The reel 13 positioned at the center of the first line 25*a* has a LED unit 68*b* having a red LED 67R besides the above three LEDs.

When the winning checker 62 confirms which predetermined winning is completed, the CPU 41 reads out illumination data and outputs it to the LED controller 66. The LED controller 66 performs illumination control over the LEDs of each color through a driver 69 respectively formed in the LED units 68*a* and 68*b*. For instance, it is also possible to use a combination of lamp like a halogen lamp and a color filter so that each color filter is replaced for color illumination in accordance with each winning color. Also if the LED assembly 67 has the red LED, the blue LED, and the green LED, all colors can be represented.

For instance, in case the line winning is completed, the yellow LED 67Y provided in the reel 13 is lighted on for constituting the line winning to illuminate the symbol for the line winning. In case the block winning is completed, the blue LED 67B provided on the reel 13 for constituting the block winning is lighted on to illuminate winning symbols. In case the ANY position winning is completed, the green LED 67G of the reel 13 illuminates the involved symbol. And in case the bonus trigger hit is completed, the red LED 67R of the center reel 13 on the third winning line 25*c* is lighted on to illuminate the symbols "S" 33.

In case different winnings are completed, the LED assembly 67 of the reel 13 on which symbols constituting each winning combination are displayed is successively lighted, to illuminate the respective symbols. As shown in FIG. 2, for example, the winning checker 62 confirms that the line winning, the bonus trigger hit, the ANY position winning, and the block winning are completed simultaneously, then the red LED 67G displaying the symbol "S" for constituting the bonus trigger hit is lighted on, to illuminate the symbol "S" 33. At the same time, the yellow LED 67Y for displaying the symbol "BAR" 30 constituting the line winning is lighted on, to illuminate the symbol "BAR" 30. After that, the yellow LED 67Y is lighted off, and the blue LED 67B for displaying the symbol "A" 31 constituting the block winning is lighted on, to illuminate the symbol "A" 31. Successively, the blue LED 67B is lighted off, and the green LED 67G for displaying the symbol "A" 31 and the symbol "7" 32 constituting the ANY position winning is lighted on, to illuminate the symbol "A" 31 and the symbol "7" 32. This successive performance is repeated for a predetermined times.

Figure 4:
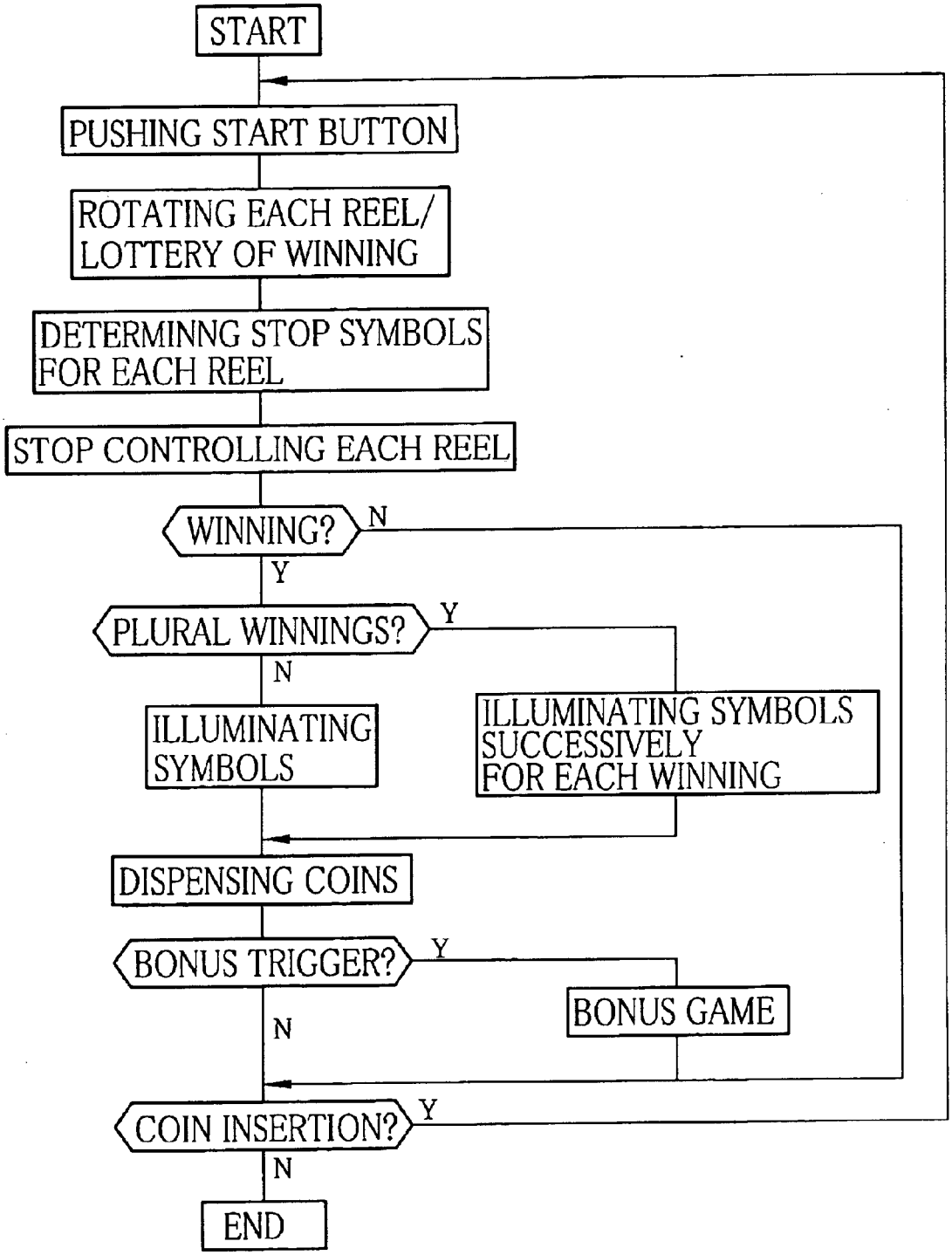
FIG. 4 is a flow chart illustrating the flow of game.

The operation of the slot machine 10 is described in reference to a flow chart of FIG. 4. The player inserts predetermined pieces of coins into the coin slot 18, then depresses the bet button 19. This effectuates the winning line corresponding to the depressed bet button 19. When the player depresses the start button 20, each reel starts rotation to occur the flow display of the symbols. The random number generating circuit 55 samples a random number, which is outputted to the winning judging section 56. The winning judging section 56 determines whether there is a winning or not. In case the random number is corresponding to winning, the winning judging section 56 judges it a single winning or multiple winnings. According to this multiple winnings, for instance, there are some cases the multiple winnings are constituted of the line winning and other winning (the block winning, the ANY position winning, and the bonus trigger hit), and the number of lines for completing winning are plural. The winning judgement signal judged by the winning judging section 56 is sent to the CPU 41. In this case, it is with the line winning. Concerning other multiple winnings with the block winning for example, it is the same as above.

The winning determination signal is inputted to the CPU 41, which outputs a symbol determination symbol to the stp symbol determining circuit 60. Receiving this signal, the stop symbol determining 60 determines the symbol to be stopped on each reel, and outputs the number of drive pulse D (the number of stop drive pulse) from a home position where the symbols stop on the display window to the CPU 41. The CPU 41 stops the stepping motor 51 through the motor control circuit 46 when the counted value of the counter of the reel reaches the number of the stop drive pulse. Each reel stops successively in this way, then the winning checker 62 checks a counted value shown by the counter 52 provided in each reel, confirming what symbol is displayed and whether there is any winning or losing. In case of winning, the award coins are paid out by the coin dispenser 63. Besides, the CPU 41 illuminates the LED assembly 67 provided inside of the reel displaying the symbol constituting the winning combination through the LED control circuit 66.

Figure 5:
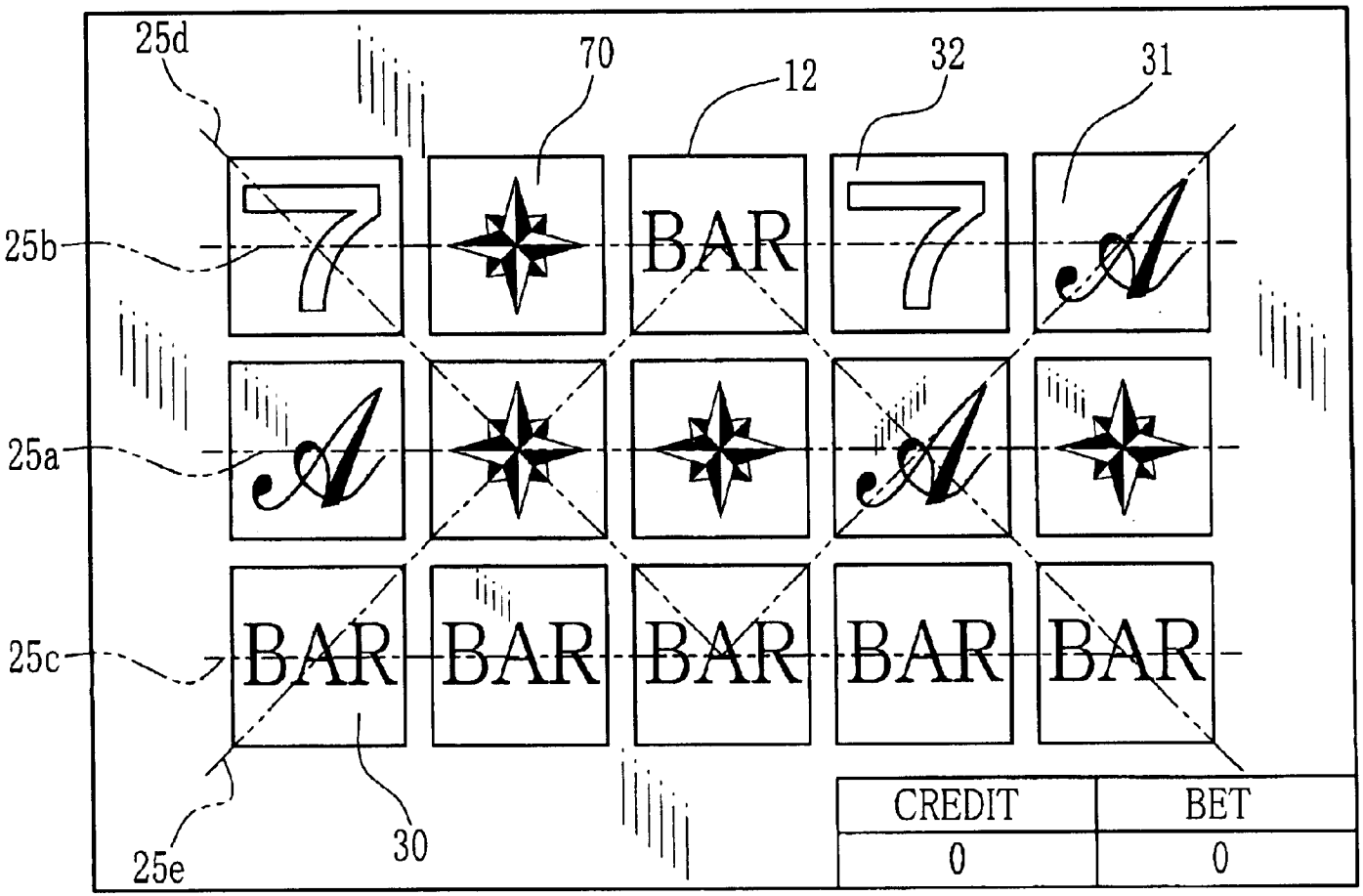
FIG. 5 is an explanatory view illustrating an example in which the line winning is completed.

For instance, as shown in FIG. 5, in case the line winning by the symbol "BAR" 30 is set on the third winning line 25*c*, the CPU 41 causes the yellow LED 67Y provided inside of the reel on the third winning line 25*c*, to illuminate the symbols "BAR" 30. Besides that, in case the plural line winnings are completed, the symbols "BAR" 30 constituting the first line winning is illuminated by the yellow LED 67Y.

After the yellow LED 67Y of the first line winning is lighted off, the symbols constituting the second line winning is illuminated by another yellow LED 67Y. This process is sequentially performed in accordance with the number of the line winning. Note that a numeral 70 is a symbol "STAR", which is not related to the winning combination.

Figure 6:
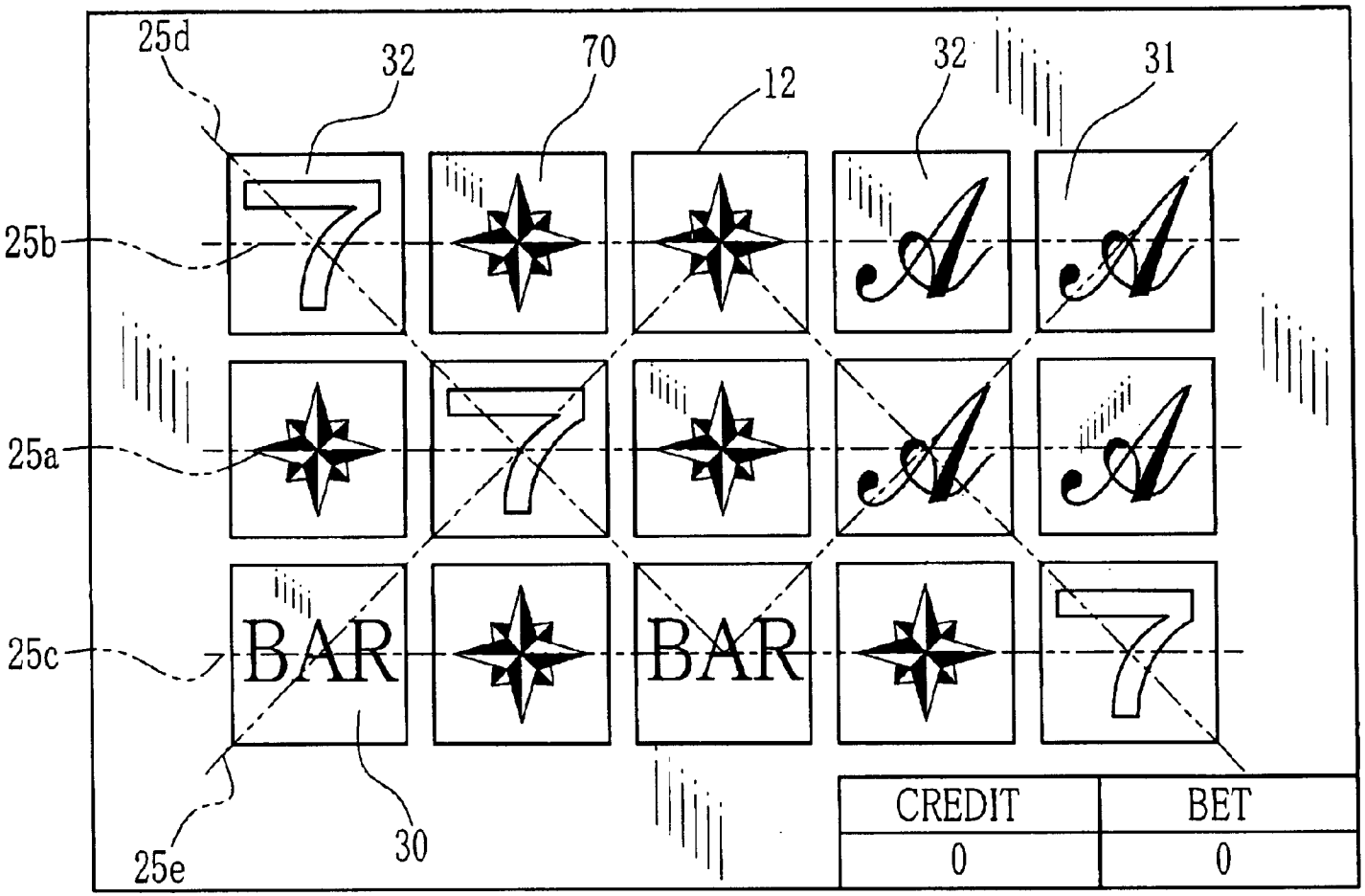
FIG. 6 is an explanatory view illustrating an example in which the block winning is completed.
Figure 7:
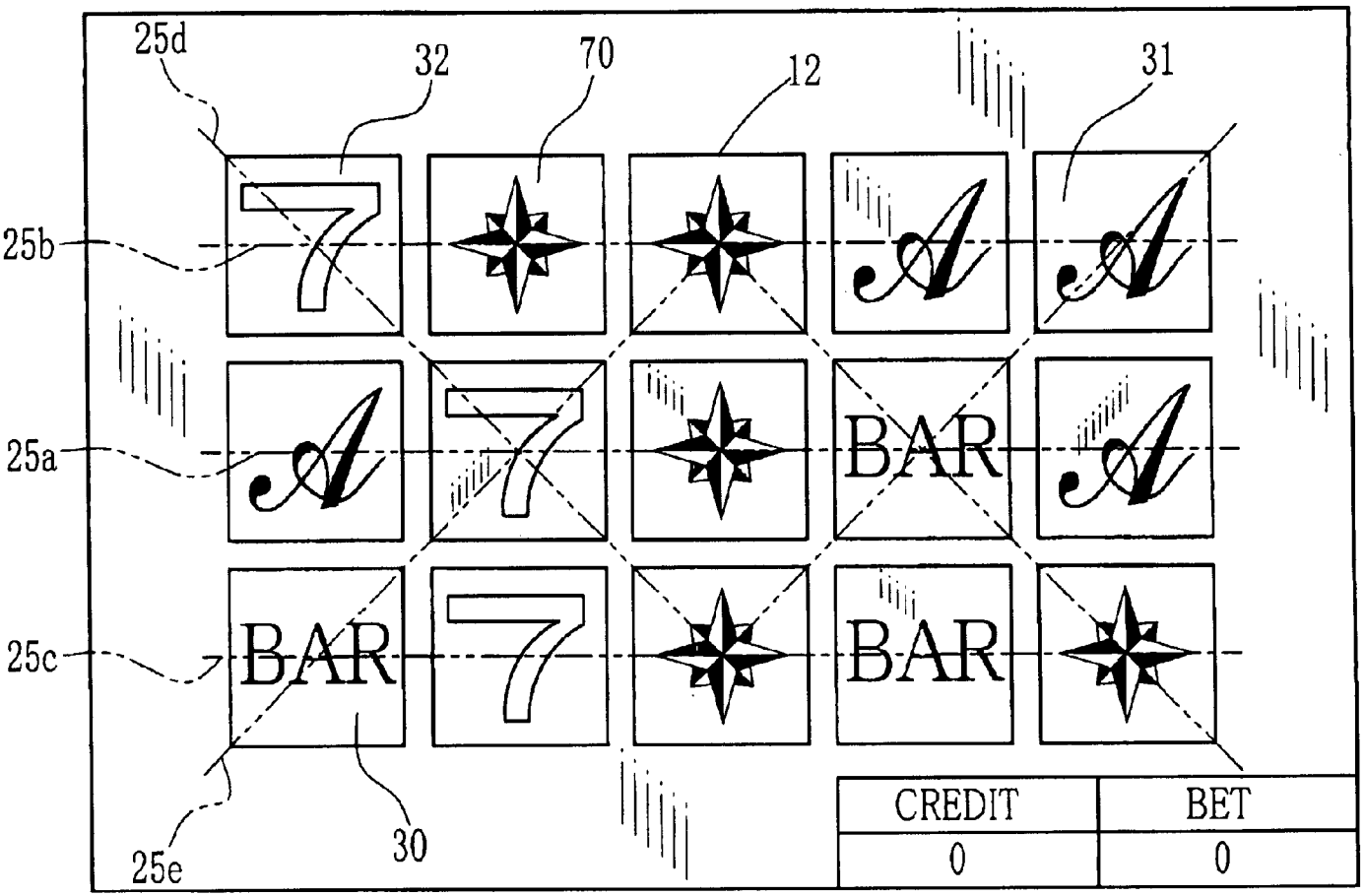
FIG. 7 is a an explanatory view illustrating an example in which the ANY winning is completed.
Figure 8:
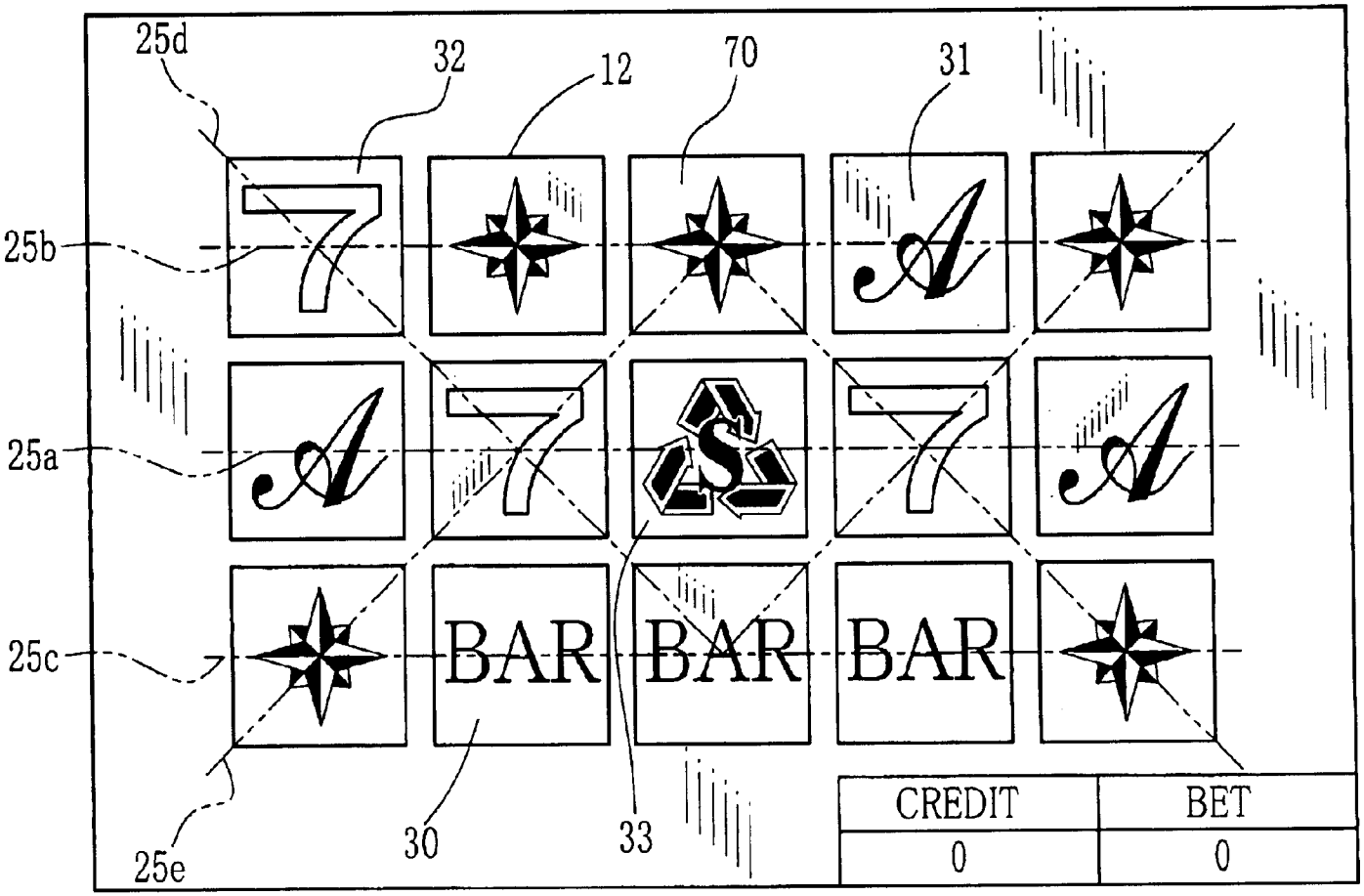
FIG. 8 is an explanatory view illustrating an example in which the bonus trigger hit is completed.

As shown in FIG. 6, in case the block winning is completed, the blue LED 67B in the reel displaying the symbol "A" 31 is lighted on, to illuminate the symbol "A" 31. In case the ANY position winning is completed, as shown in FIG. 7, the green LED 67G in the reel illuminates the symbol "A" 31. In case the bonus trigger hit is completed, as shown in FIG. 8, the red LED 67R in the reel illuminates the symbol "S" 33.

Meanwhile, as shown in FIG. 2, in case the line winning, the ANY position winning, the block winning, and the bonus trigger hit are completed all at once, the symbol "S" constituting the bonus trigger hit is illuminated by the red LED 67R, simultaneous with the symbol "BAR" 30 constituting the line winning being illuminated by the yellow LED 67Y. Successively, the symbol "BAR" 30 for constituting the line winning is illuminated, and the symbol "A" 31 for constituting the block winning is illuminated by the blue LED 67B. When the blue LED 67B is lighted off, the symbol "A" 31 and the symbol "7" 32 for constituting the ANY position winning is illuminated by the green LED 67G. Such illumination is repeatedly performed for a constfixed times. In this case, as the bonus trigger hit is completed, the next four game is the bonus game. The player can play games without inserting coins. In case the winning is obtained during this bonus game, the pieces of coins corresponding to its winning are dispensed. In case plural winning excluding the bonus trigger hit are completed, the symbol constituting the winning is illuminated by the corresponding color, in order of the line winning, the block winning, and the ANY position winning.

Also in case of duplicate winning by the block winning and the ANY position winning, as shown in FIG. 2, the symbol constituting the ANY position winning is illuminated after illuminating the symbol of the block winning. Because of this, in case plural different winnings are completed, they are indicated by plural colors light different from every winning. Therefore, the player can understand what wining is completed at a glance. According to the embodiment, when plural different winning are completed at the same time, they are indicated by respectively different colors light one after another. However, all winnings may be simultaneously indicated by different colors light, without limiting the above method. In this case, the only symbols constituting different winnings are indicated by illuminating different colors reciprocally.

Figure 9:
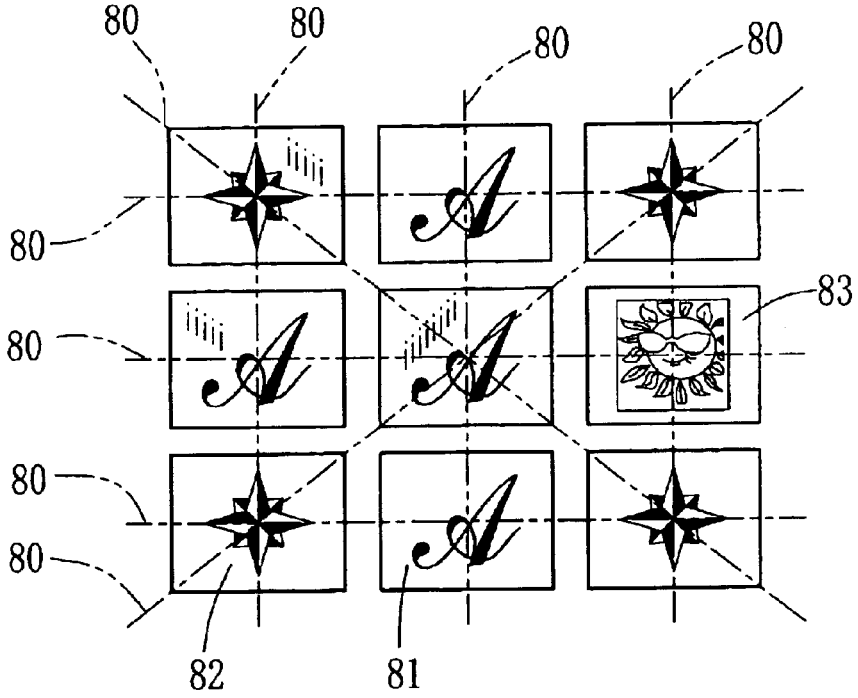
FIG. 9 is an explanatory view illustrating the symbol display device having nine reels of three rows and three lines, the line winning, the ANY winning, and the block winning being completed.
Figure 10:
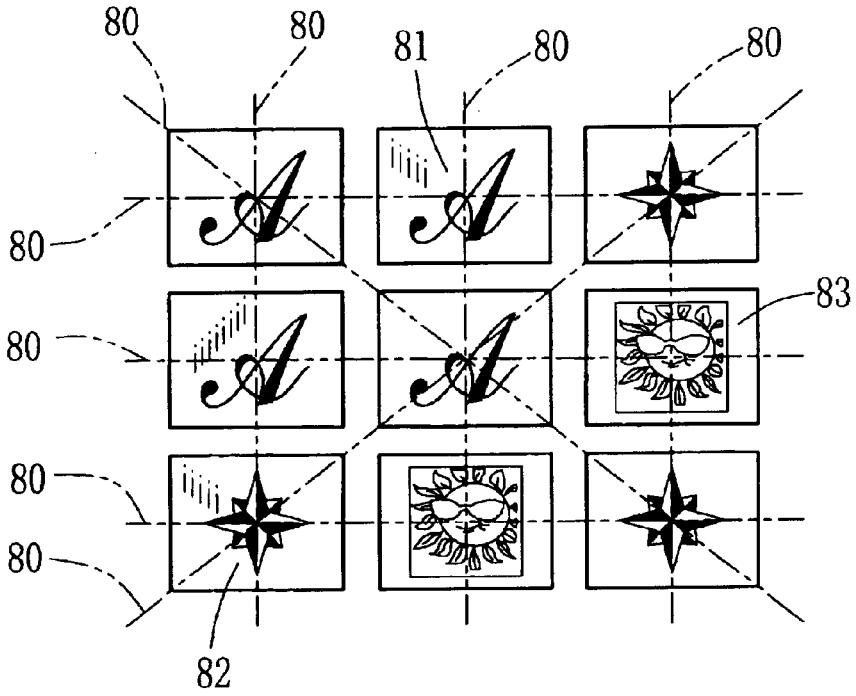
FIG. 10 is an explanatory view illustrating a state in which the symbol display device completes the block winning.

In the present embodiment, the symbol display device using fifteen reels of five lines and three columns is described. It is not limited to this, but may be used for a symbol display device using nine reels of three lines and three columns. In this case, the winning consists of the line winning, the ANY position winning, the block winning, and the bonus trigger hit. As shown in FIGS. 9 and 10, the line winning is completed when a designated symbol stops on any winning line 80 among the plural winning lines. The ANY position winning is completed when four symbols "A" 81 or more are displayed. The block winning is completed when the symbol "A" 81 is collected four or more in group. The bonus trigger hit is completed when a symbol "STAR" 82 is displayed from the display window of four corners.

Figure 11:
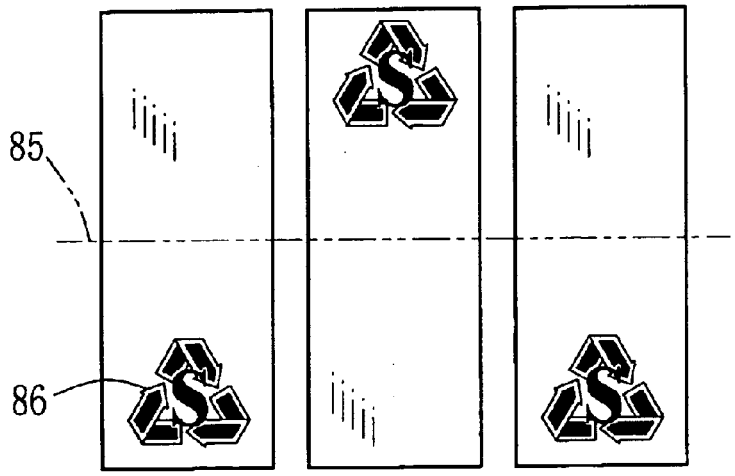
FIG. 11 is an explanatory view illustrating a state in which the symbol display device having three reels hits a winning.

For example, in case the line winning is completed, the symbol constituting the line winning is illuminated by the yellow LED. In case the ANY position winning is completed, the symbol "A" 81 is illuminated by the blue LED. In case the block winning is completed, the symbol "A" 81 is illuminated by the green LED. In case the bonus trigger hit is completed, the symbol "STAR" 82 is illuminated by the red LED. In case these winnings are simultaneously completed, the corresponding symbols are illuminated in order of the line winnings, the ANY position winning, and the block winning. In case the bonus trigger hit is completed simultaneous with other winning, the symbol of the bonus trigger hit is illuminated at all times. Note that a numeral 83 is a symbol "sunflower", which constitutes one of the line winnings. In case a symbol display device using three reels is applied, it is constituted of a one-coin betting game or a ten-coin betting game. As shown in FIG. 11, in case of one-coin betting game, only the winning line 85 of center row is effectuated, while in case of ten-coin betting game, the symbol displayed from the displaying window (in addition the winning line 85, an upper and a lower winning lines laid the both side of the winning lines 85) is effectuated. In this case, besides the line winning, there prepares a Jack Pot winning, which is completed when the specified symbols are displayed for a predetermined number or more. In case the line winning is completed, the symbol of the line winning is illuminated by a yellow LED for instance. And in case the Jack Pot winning is completed, the symbol of the Jack Pot combination is illuminated by another color LED, for instance, a red LED which is different from the yellow LED of the line winning. When the line winning and the Jack Pot winning are simultaneously completed, they are mutually illuminated, so that the player can easily recognize what winning are completed at a glance. Note that FIG. 11 illustrates an example of completion of the Jack Pot winning by a symbol "S" 86.

Although the present embodiment describes the symbol display device in which reels are arranged in matrix, it is not limited to this. It is possible to suitably set the number and structure of the winning line, further the kind, the number, and the arrangement of the symbol to be arranged around the reel in consideration to the character of a game. In the present embodiment, the slot machine with a mechanical type reel is used as an example. It is also suitable to use a slot machine with a liquid crystal display (LCD) panel, a CRT and the like for instance, for displaying a simulated rotating reel on the basis of graphic data stored in a ROM. It is possible to apply the game machine using this symbol display device to a pachinko machine, and other game machines, in addition to the slot machine. Though plural symbols are arranged around the reel at a predetermined pitch, this pitch includes a different pitch as well as constant pitch.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A symbol display device, comprising:

plural displayed symbols;

an illumination system that illuminates each of the symbols; and an indication module connected to the illumination system to illuminate each winning symbol combination with a common color different from a color that illuminates other symbols, wherein, upon two winning symbol combinations being illuminated, a first winning symbol combination is illuminated with a first color and a second winning symbol combination is illuminated with a second color, the non-winning symbols being illuminated by another color other than the first and second colors, and the first and second colors are different, the first winning symbol combination is a winning line, the second winning symbol combination is another winning line, the winning line and the another winning line intersect at a common symbol, and the common symbol is alternately illuminated by the first color and the second color.

2. A symbol display device, comprising:

plural displayed symbols;

an illumination system that illuminates each of the symbols; and an indication module connected to the illumination system to illuminate each winning symbol combination with a common color different from a color that illuminates other symbols, wherein, upon two winning symbol combinations being illuminated, a first winning symbol combination is illuminated with a first color and a second winning symbol combination is illuminated with a second color, the non-winning symbols being illuminated by another color other than the first and second colors, and the first and second colors are different, the first winning symbol combination and the second winning symbol combination share symbols, and the shared symbols are alternately illuminated by the first color and the second color.

3. The display device of claim 1, wherein the symbols are arranged in a matrix.

4. The display device of claim 2, wherein the symbols are arranged in a matrix.

5. The display device of claim 1, wherein, the first winning symbol combination is illuminated with the first color alternating in turns with the second winning symbol combination being illuminated with the second color.

6. The display device of claim 1, wherein, the symbols are each fixed to a corresponding symbol reel rotated by a corresponding stepping motor; and the illumination system comprises plural light sources of different colors provided for each reel.

7. The display device of claim 6, wherein one of the plural light sources is a red LED centered behind a symbol.

8. The display device of claim 1, further comprising an award table for showing winnings corresponding to the first and second winning symbol combinations, the winnings corresponding to the first winning symbol combination being illuminated with the first color and winnings corresponding to the second winning symbol combination being illuminated with the second color.

9. A symbol display device, comprising:

plural displayed symbols;

an illumination system that illuminates each of the symbols; and an indication module connected to the illumination system to illuminate a winning symbol combination with a common color, wherein, upon two winning symbol combinations being illuminated, a first winning symbol combination is illuminated with a first color and a second winning symbol combination is illuminated with a second color, and the first and second colors are different, the non-winning symbols are illuminated by another color other than the first and second colors, and any symbol in common with the first and second winning symbol combinations is alternately illuminated with the first color and the second color.

10. The display device of claim 9, wherein the first winning symbol combination is illuminated with the first color and the second winning symbol combination is illuminated with the second color in alternating times.

11. A symbol display device, comprising:

plural displayed symbols arranged in a matrix;

an illumination system that individually illuminates each of the symbols; and an indication module connected to the illumination system to illuminate a winning symbol with a color indicating a win, wherein, upon two winning symbol combinations being illuminated, a first winning symbol is illuminated with a first color and a second winning symbol is illuminated with a second color, and non-winning symbols are displayed with a third color, the first, second, and third colors being different from each other, the first winning symbol is one of a first winning symbol combination and the second winning symbol is one of a second winning symbol combination, the first winning symbol combination is a first line and the second winning symbol combination is a second line intersecting the first line.

* * * * *